US010459382B2

(12) United States Patent
Iizuka

(10) Patent No.: US 10,459,382 B2
(45) Date of Patent: Oct. 29, 2019

(54) IMAGE FORMING APPARATUS

(71) Applicant: CANON KABUSHIKI KAISHA, Tokyo (JP)

(72) Inventor: Yoichiro Iizuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/195,976

(22) Filed: Nov. 20, 2018

(65) Prior Publication Data

US 2019/0163103 A1 May 30, 2019

(30) Foreign Application Priority Data

Nov. 24, 2017 (JP) ..... 2017-225570

(51) Int. Cl.
*G03G 15/20* (2006.01)
*G03G 21/16* (2006.01)
*G03G 21/18* (2006.01)

(52) U.S. Cl.
CPC ..... *G03G 15/2053* (2013.01); *G03G 15/2017* (2013.01); *G03G 21/1647* (2013.01); *G03G 21/1671* (2013.01); *G03G 21/1685* (2013.01); *G03G 21/1853* (2013.01); *G03G 21/168* (2013.01); *G03G 21/1633* (2013.01); *G03G 21/1676* (2013.01); *G03G 2221/1654* (2013.01)

(58) Field of Classification Search
CPC ..... G03G 15/2053; G03G 15/2017; G03G 21/1853; G03G 21/1685; G03G 21/1647; G03G 21/1671; G03G 21/1633; G03G 2221/1654; G03G 21/168; G03G 21/1676
See application file for complete search history.

(56) References Cited

U.S. PATENT DOCUMENTS

| | | | | |
|---|---|---|---|---|
| 9,599,951 | B2 | 3/2017 | Yamaguchi et al. | |
| 2002/0186986 | A1 | 12/2002 | Makihira | |
| 2010/0086334 | A1* | 4/2010 | Sakaya | G03G 15/2028 399/328 |
| 2013/0004222 | A1* | 1/2013 | Sakaya | B65H 5/062 399/400 |
| 2016/0154370 | A1 | 6/2016 | Maeda et al. | |

FOREIGN PATENT DOCUMENTS

| | | | |
|---|---|---|---|
| JP | H0-5040433 | A | 2/1993 |
| JP | H09-80943 | A | 3/1997 |
| JP | 2002-323822 | A | 11/2002 |
| JP | 2003-177649 | A | 6/2003 |
| JP | 2012-230297 | A | 11/2012 |
| JP | 2013-224987 | A | 10/2013 |

OTHER PUBLICATIONS

European Search Report issued in corresponding European Application No. 18208022.6 dated May 7, 2019.

* cited by examiner

*Primary Examiner* — Susan S Lee
(74) *Attorney, Agent, or Firm* — Venable LLP

(57) ABSTRACT

The image forming apparatus of the present invention has an apparatus main body including a link mechanism that an opening and closing member contacts, and a regulating portion regulating the movement of a shutter, and when the opening and closing member is further pushed in a closing direction at the time when the shutter is located at a second position, the link mechanism allows to move the opening and closing member in the closing direction while keeping a position of the shutter maintains at the second position by the regulating portion.

14 Claims, 18 Drawing Sheets

IMAGE FORMING APPARATUS

BACKGROUND OF THE INVENTION

Field of the Invention

The present invention relates to an electrophotography type image forming apparatus such as a copying machine and a printer.

Description of the Related Art

A copying machine and a printer include a door that can be opened and closed with respect to an apparatus main body so that the inside of the apparatus main body can be opened to the outside. When a sheet jam occurs inside the apparatus main body, and when exchange of a unit (hereinafter referred to as the attachable and detachable unit), such as a photosensitive member required for image formation, is required, a user can access the inside by opening the door.

When the door is opened, there is a possibility that the user may touch a heat source such as a fixing unit. Japanese Patent Application Laid-Open No. 2002-323822 discloses closing a sheet inlet of the fixing unit with an entrance shutter in order to prevent the user from touching the heat source such as the fixing unit. The entrance shutter of this literature closes the sheet inlet in conjunction with an opening operation of the door.

In addition to the entrance shutter operating in conjunction with the opening and closing of the door as described above, an entrance shutter opened and closed in conjunction with a detaching operation of the attachable and detachable unit is also considered. This entrance shutter moves to an open position where the entrance shutter opens a sheet inlet of the fixing unit (a position where a sheet can enter the inside of the fixing unit), when the attachable and detachable unit is attached to the apparatus main body. Conversely, when the attachable and detachable unit is detached from the apparatus main body, the entrance shutter moves to a position (a closed position) at which the sheet inlet of the fixing unit is closed.

However, the entrance shutter moving in conjunction with the attachment and detachment of the attachable and detachable unit changes its position according to the insertion amount of the attachable and detachable unit to the apparatus main body. Since there is an individual difference in components, even if the attachable and detachable unit is inserted to a predetermined position of the apparatus main body, the moving distance of the entrance shutter differs for each individual printer. Therefore, the open position of the entrance shutter differs for each individual printer.

In the case where the entrance shutter also plays the role of guiding a sheet to the fixing unit, when the open position of the entrance shutter is not at a position suitable for sheet conveyance, there is a possibility of causing a sheet jam.

SUMMARY OF THE INVENTION

Another aspect of the present invention is an image forming apparatus that provides stable sheet conveyance even if the image forming apparatus includes an entrance shutter serving as a sheet conveyance guide.

Another aspect of the present invention is an image forming apparatus forming a toner image on a sheet, the image forming apparatus including an apparatus main body, a guide configured to guide an attachable and detachable unit attachable to and detachable from the apparatus main body, and a fixing unit configured to fix the toner image formed on a sheet to the sheet, the fixing unit including a shutter configured to open or close a sheet inlet of the fixing unit, wherein in a case where the attachable and detachable unit is attached to the apparatus main body when the shutter is located at a first position at which the sheet inlet is closed, the shutter moves from the first position to a second position at which the sheet inlet is opened, according to an attaching operation, wherein the apparatus main body includes a link mechanism that the attachable and detachable unit contacts, and a regulating portion configured to regulate movement of the shutter, and in a case where the attachable and detachable unit is further pushed in an attaching direction when the shutter is located at the second position, the link mechanism allows to move the attachable and detachable unit in the attaching direction while keeping a position of the shutter at the second position by the regulating portion.

Another aspect of the present invention is an image forming apparatus forming a toner image on a sheet, the image forming apparatus including an apparatus main body, an opening and closing member configured to open or close with respect to the apparatus main body, and a fixing unit configured to fix the toner image formed on a sheet onto the sheet, the fixing unit including a shutter configured to open or close a sheet inlet of the fixing unit, wherein in a case where the opening and closing member is closed when the shutter is located at a first position closing the sheet inlet, the shutter moves from the first position to a second position opening the sheet inlet according to a closing operation, wherein the apparatus main body includes a link mechanism that the opening and closing member contacts, and a regulating portion regulating movement of the shutter, and wherein in a case where the opening and closing member is further pushed in a closing direction when the shutter is located at the second position, the link mechanism allows to move the opening and closing member in the closing direction while keeping a position of the shutter at the second position by the regulating portion.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. The disclosed Examples are within the scope of the claims.

Example 1

Figure 1:
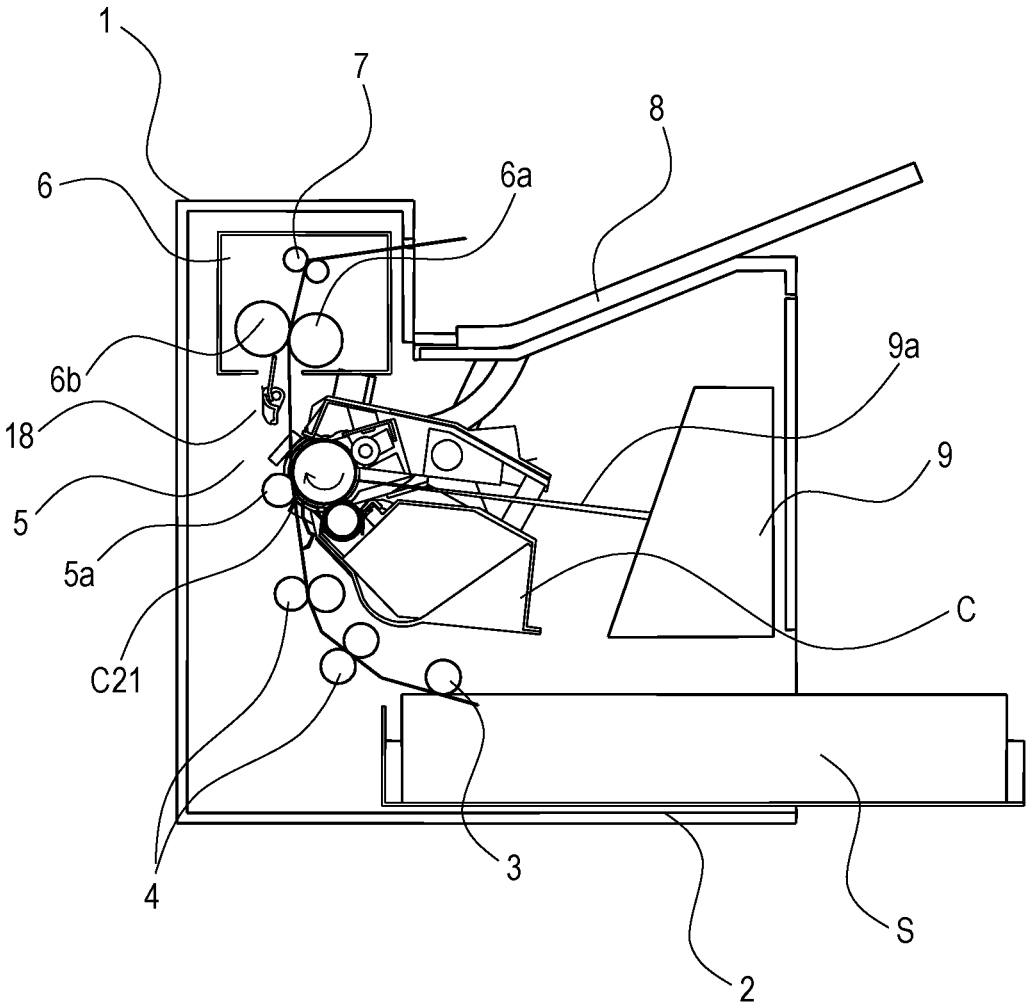
FIG. 1 is a cross-sectional view of an image forming apparatus.
Figure 2:
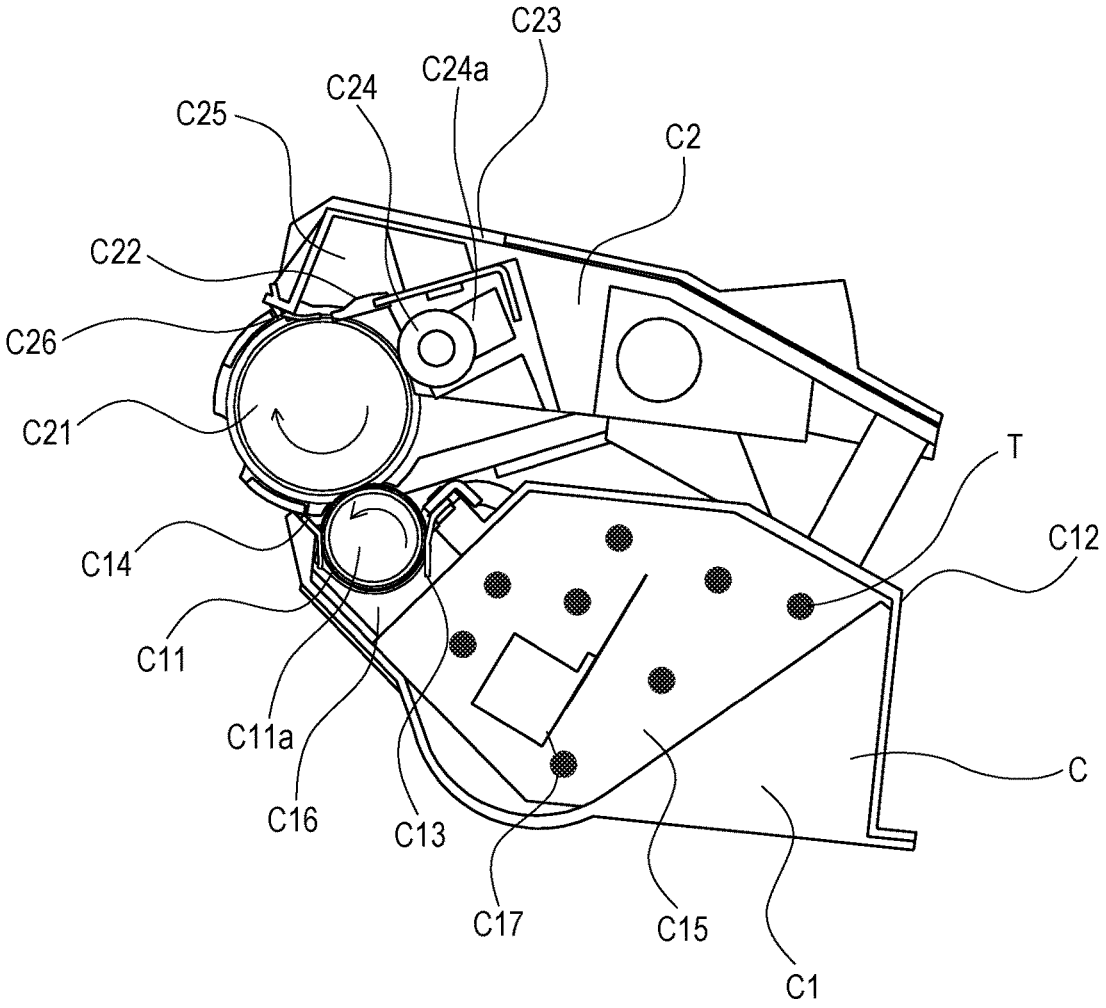
FIG. 2 is a cross-sectional view of a cartridge.

FIG. 1 is a cross-sectional view of an image forming apparatus of a present example, and FIG. 2 is a cross-sectional view of a process cartridge. The image forming apparatus of this example is an electrophotography type laser beam printer capable of attaching and detaching a process cartridge C (hereinafter referred to as the cartridge C) to an apparatus main body 1. The cartridge C (the attachable and detachable unit) unitizes members, such as a photosensitive member C21 and a development unit C1, which are required for forming an electrophotography type image. A laser scanner 9 is arranged to scan the photosensitive member C21 by laser beam 9*a*. A sheet feeding cassette 2 storing a recording medium S (hereinafter referred to as a sheet) is arranged under the cartridge C. Further, a pickup roller 3, a conveyance roller pair 4, a transfer unit 5, a fixing unit 6, a discharge roller pair 7, a discharge tray 8, etc. are sequentially arranged along the conveying direction of a sheet S in the apparatus main body 1. In view of the cartridge (attachable and detachable unit) C being detachable from the apparatus main body 1, it is not essential for the cartridge to be present as part of the apparatus main body 1. Accordingly, disclosure is provided of an image forming system comprising apparatus main body 1 being provided together with the disclosed cartridge (attachable and detachable unit) C.

Using FIGS. 1 and 2, an outline of the image formation process is described. The photosensitive member C21 is driven by a driving source of the apparatus main body 1. The surface of the photosensitive member C21 is uniformly charged by applying a bias voltage to a charging roller C24, which contacts the photosensitive member C21, and is rotated following the photosensitive member C21. An electrostatic latent image is formed on the surface of the photosensitive member C21 by scanning the charged surface of the photosensitive member C21 with the laser beam 9*a* from the laser scanner 9 according to an image. A toner T in a toner room C15 of the development unit C1 is stirred and conveyed by a toner conveyance member C17, and is sent to a toner feeding chamber C16. The toner conveyance member C17 is operated by a driving force from the apparatus main body 1. The toner T is borne on the surface of a developing roller C11 with a magnetic force of a magnet roller C11*a* inside the developing roller C11. The layer thickness of the toner T on the developing roller C11 driven and rotated by the apparatus main body 1 is regulated while being frictionally charged by a developing blade C13. The toner T on the developing roller C11 is supplied to the photosensitive member C21 according to the electrostatic latent image on the photosensitive member C21. In this manner, a toner image is formed on the surface of the photosensitive member C21. In line with the timing of the toner image formation, the sheet S carried on a sheet feeding tray 2 is conveyed by the pickup roller 3 and the conveyance roller pair 4. When the sheet S is conveyed to the transfer unit 5 between the photosensitive member C21 and a transfer roller 5*a*, the toner image on the photosensitive member C21 is transferred to the sheet S in the transfer unit 5. The sheet S on which the toner image was transferred is conveyed to the fixing unit 6. In the process in which the sheet S passes a fixation nip portion formed between a heat roller 6*a* and a pressure roller 6*b* of the fixing unit 6, the toner image is fixed on the sheet S. The sheet S on which the toner image was fixed is conveyed by the discharge roller pair 7, and is discharged to the discharge tray 8.

As described in detail later, an entrance shutter 18 moves according to the attachment and detachment of the cartridge C (the attachable and detachable unit) to and from the apparatus main body 1, and closes a sheet inlet of the fixing unit 6. When the entrance shutter 18 is pushed by the cartridge C in the state where the entrance shutter 18 is located at a closed position (a first position) at which the sheet inlet of the fixing unit 6 is closed, the entrance shutter 18 rotates to an open position (a second position) at which the sheet inlet is opened from the closed position.

Figure 3:
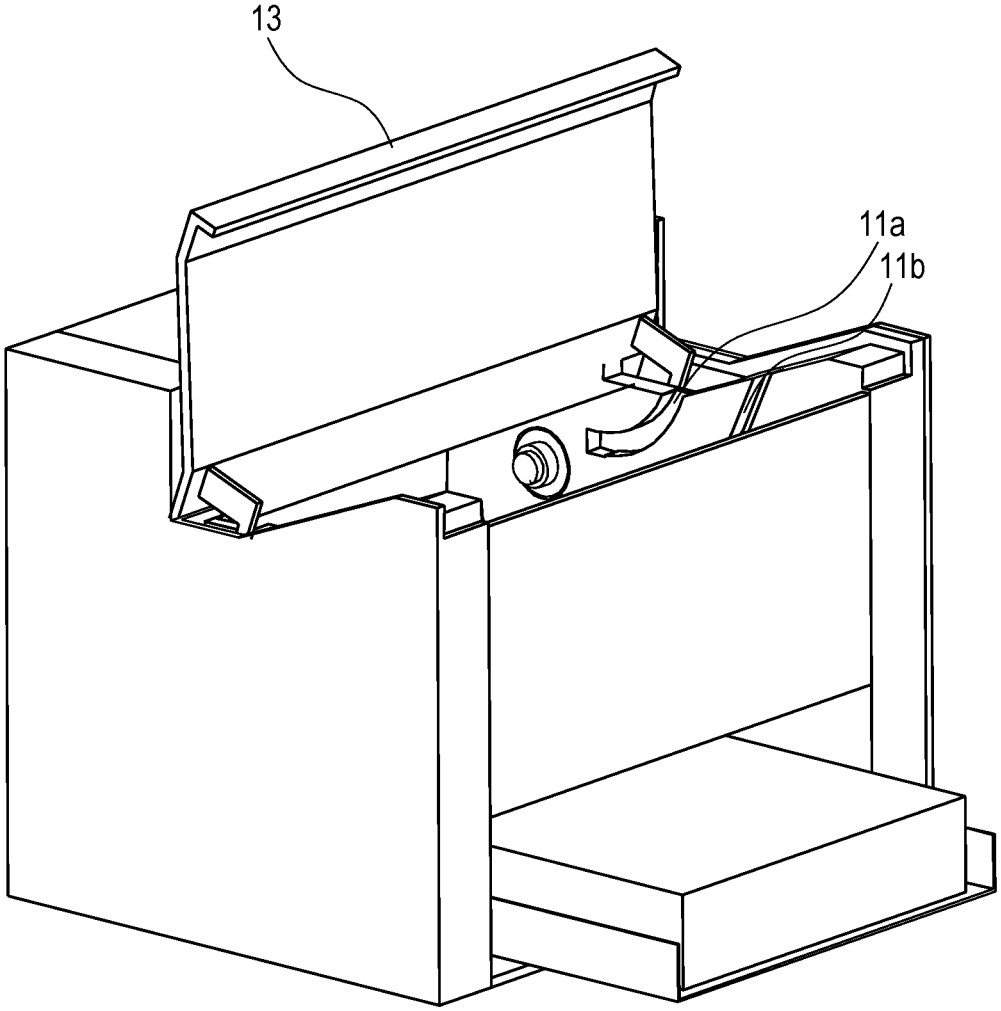
FIG. 3 is a perspective view of the image forming apparatus.
Figure 4:
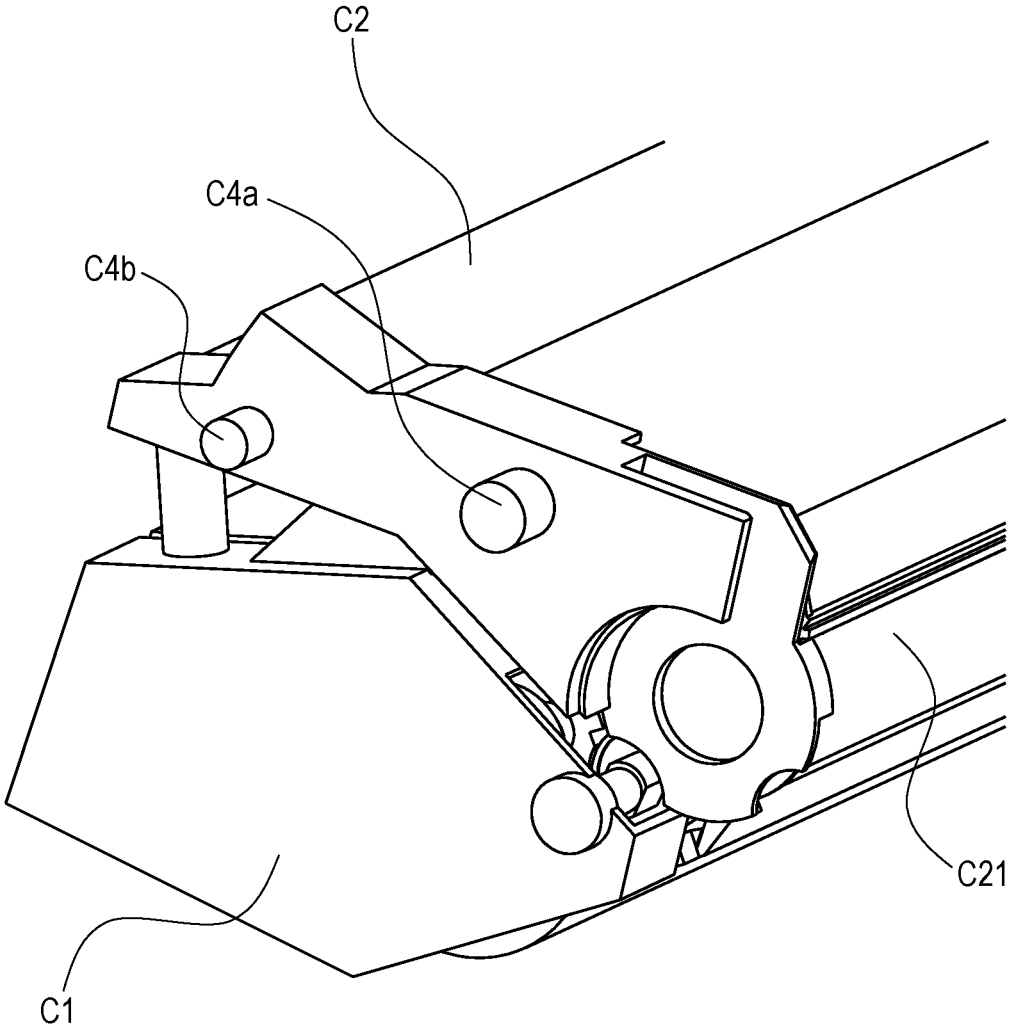
FIG. 4 is a perspective view of one end side of the cartridge.
Figure 5:
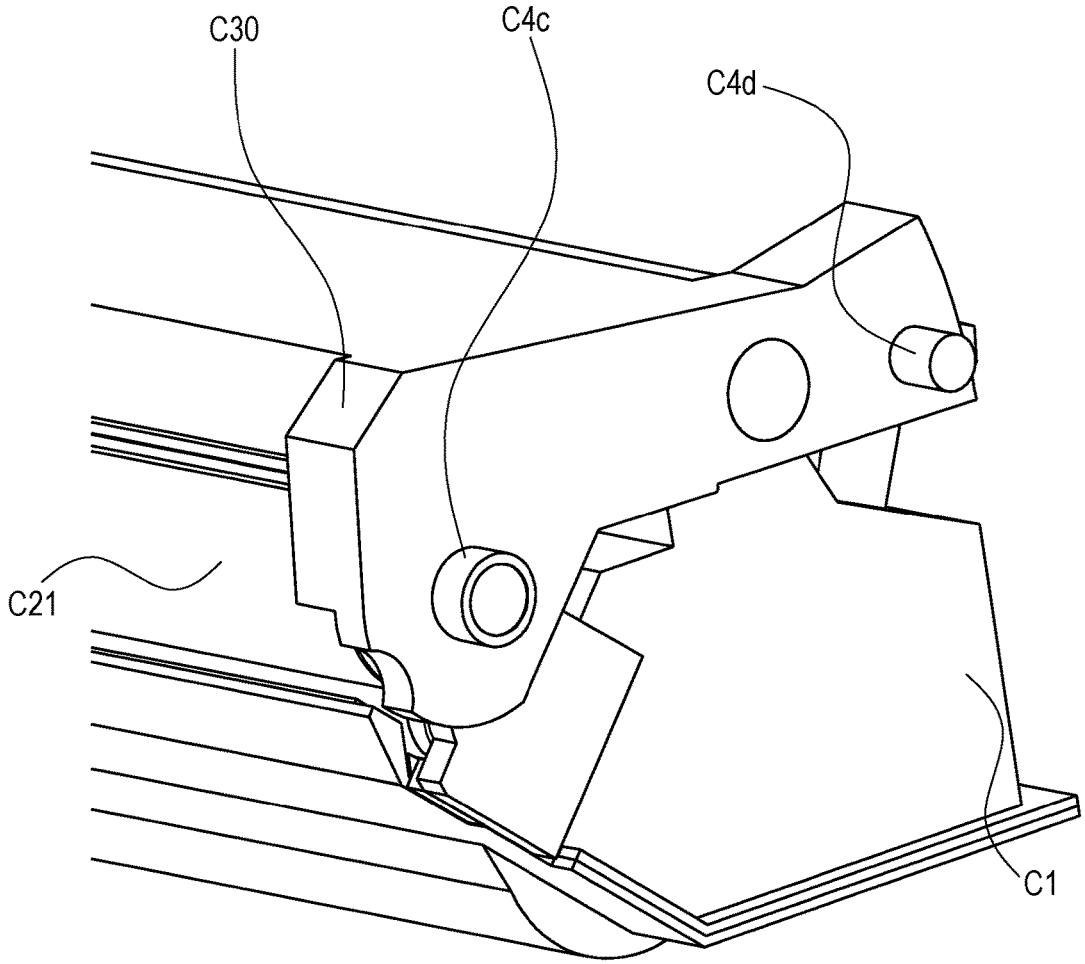
FIG. 5 is a perspective view of the other end side of the cartridge.

Next, the attachment and detachment of the cartridge C are described using FIGS. 3 to 5. As illustrated in FIG. 3, a door (an opening and closing member) 13 that is opened and closed when detaching and attaching the cartridge C to and from the apparatus main body 1 is provided in the apparatus main body 1. Guide rails 11*a* and 11*b*, which guide the cartridge C at the time of detaching and attaching the cartridge C, are provided in a side wall inside the apparatus main body 1. When attaching the cartridge C to the apparatus main body 1, guided parts C4*a* and C4*b* (FIG. 4) on one end side of the cartridge C in a longitudinal direction (the direction perpendicular to the paper plane of FIG. 2) are aligned to the guide rails 11*a* and 11*b*. Similarly, guided parts C4*c* and C4*d* (FIG. 5) on the other end side of the cartridge C in the longitudinal direction are aligned to guide rails (not shown). Then, the cartridge C is inserted to the inside of the apparatus main body 1 along these guide rails.

Figure 6:
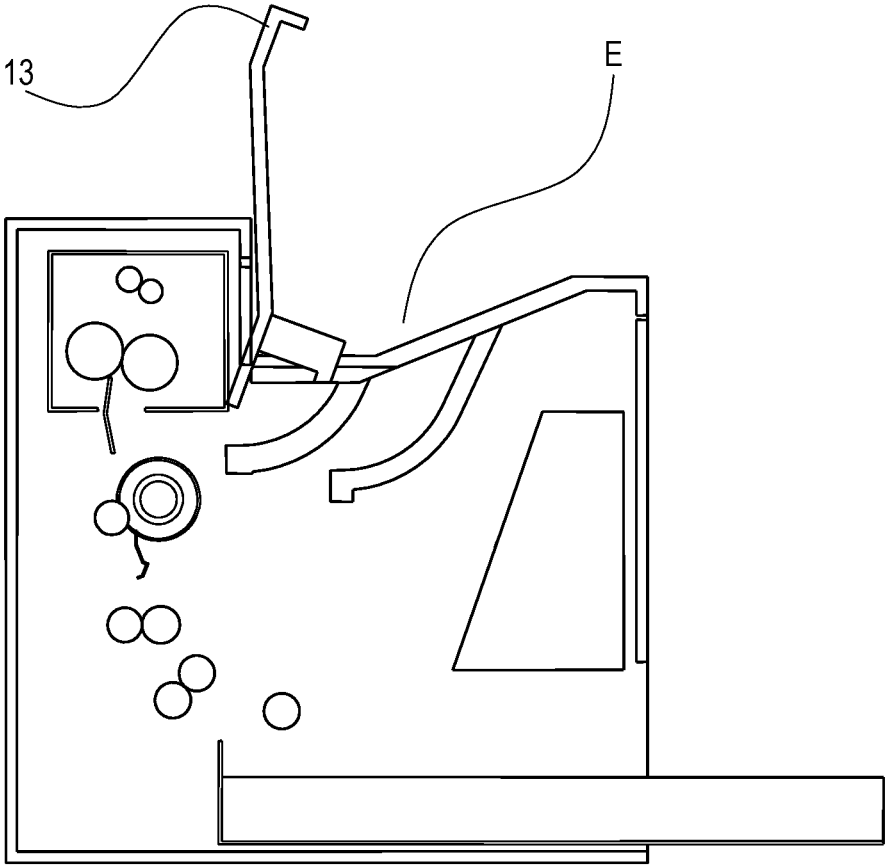
FIG. 6 is a reference drawing of the image forming apparatus.
Figure 7:
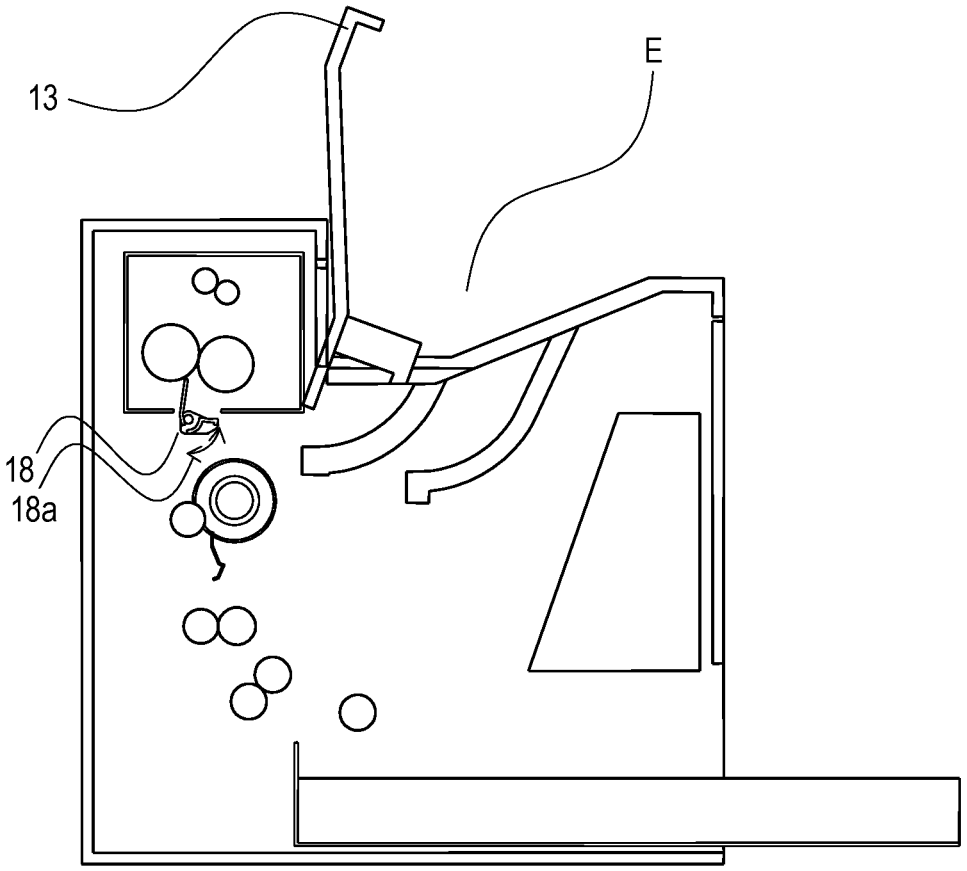
FIG. 7 is a reference drawing of the image forming apparatus.

Next, using the reference drawings illustrating in FIGS. 6 and 7, the necessity of the entrance shutter provided in the sheet inlet of the fixing unit 6 is described. As illustrated in FIG. 6, when the door 13 is opened and the cartridge C is detached, a user's hand can access the inside of the apparatus main body 1 via an opening E. In this state, when the user inserts his/her hand in order to remove the sheet S jammed inside the apparatus main body 1, there is a possibility that the user may touch the fixing unit 6 that is at a high temperature. In order to prevent this problem, it is effective to provide the entrance shutter 18 as illustrated in FIG. 7, and to close a high temperature portion. The entrance shutter 18 is rotatably (movably) supported by the apparatus main body 1. Additionally, the entrance shutter 18 rotates in conjunction with the attachment and detachment of the cartridge C in the direction of an arrow 18*a* in FIG. 7. By this rotation, the entrance shutter 18 moves to the closed position closing the entrance of the fixing unit 6, and to the open position opening the entrance of the fixing unit 6.

Figure 8:
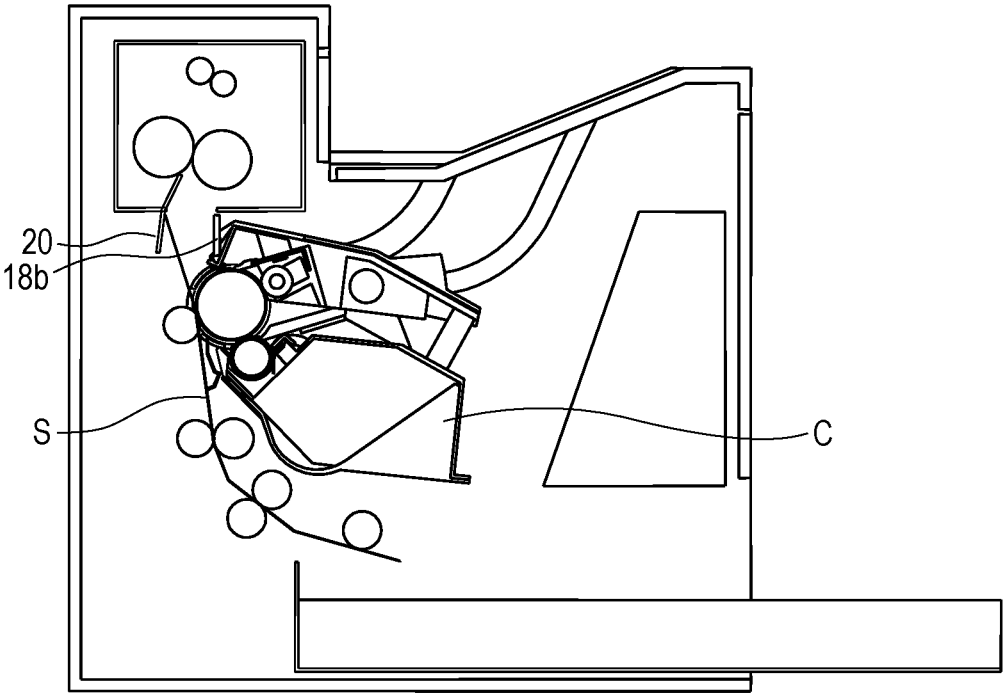
FIG. 8 is a reference drawing of the image forming apparatus.
Figure 9:
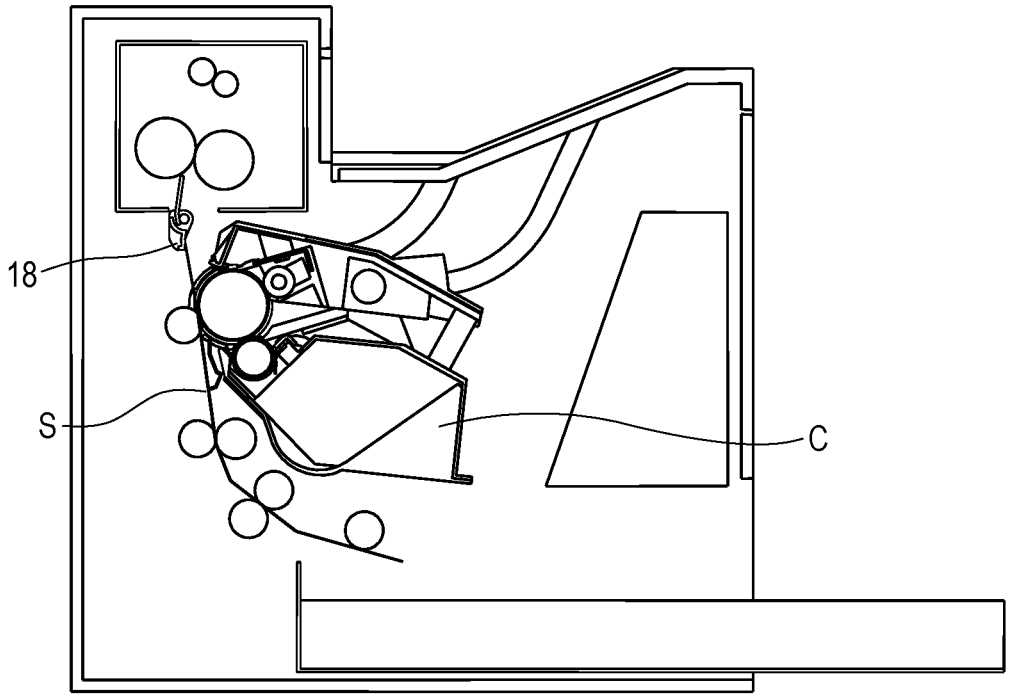
FIG. 9 is a reference drawing of the image forming apparatus.

Next, using the reference drawings illustrating in FIGS. 8 and 9, the importance of the shutter position accuracy is described in the case of arranging the entrance shutter 18 to the side opposed to a non-printing face (a face opposite to a face bearing an unfixed toner image) of a sheet. In the case of an apparatus including a sheet conveyance path as illustrated in FIG. 8, the sheet S is conveyed along a conveyance guide 20 arranged on the side opposed to the non-printing face of the sheet S. Additionally, as illustrated in FIG. 8, when arranging the entrance shutter 18*b* on the side opposed to a printing face (a face bearing the unfixed toner image) of the sheet S, when the entrance shutter 18*b* is moved to the position where the entrance of the fixing unit 6 is opened, the entrance shutter 18*b* does not affect the conveyance of the sheet S at all. However, in this configuration, the entrance shutter 18*b* is arranged at the position near the cartridge C. Thus, it is necessary to avoid the interference between the entrance shutter 18*b* and the cartridge C. Therefore, there is a problem that it is hard to reduce the size of the apparatus main body.

On the other hand, as illustrated in FIG. 9, when arranging the entrance shutter 18 on the side opposed to the non-printing face of the sheet S, it is unnecessary to care about the interference between the entrance shutter 18 and the cartridge C. Thus, there is a merit that it is easy to reduce the size of an apparatus. However, since the entrance shutter 18 needs to serve as the conveyance guide for the sheet S, it is necessary to accurately manage the position and posture of the entrance shutter 18, so that the entrance shutter 18 may not adversely affect the sheet conveyance. For example, when the entrance shutter 18 is excessively opened or excessively closed, the jamming of the sheet S may easily occur.

Usually, as for a member (shutter) opened and closed with the movement of a movable member, such as the cartridge C and the door, the posture (position) of a closed state is determined by a part of the apparatus main body 1, and the posture of an opened state is determined by the movable member. However, when the posture of the opened state is determined by the movable member, the number of components related to the positioning of the shutter is increased, and the dimensional tolerance of each component affects the final position of the shutter. Thus, the positional accuracy of the shutter in the opened state is decreased. Additionally, when the accuracy of individual components is increased in order to improve the positional accuracy, the cost is increased.

Thus, the configuration for securing the accuracy of the open position of the entrance shutter 18 without causing an increase in the cost is described below.

Figure 10:
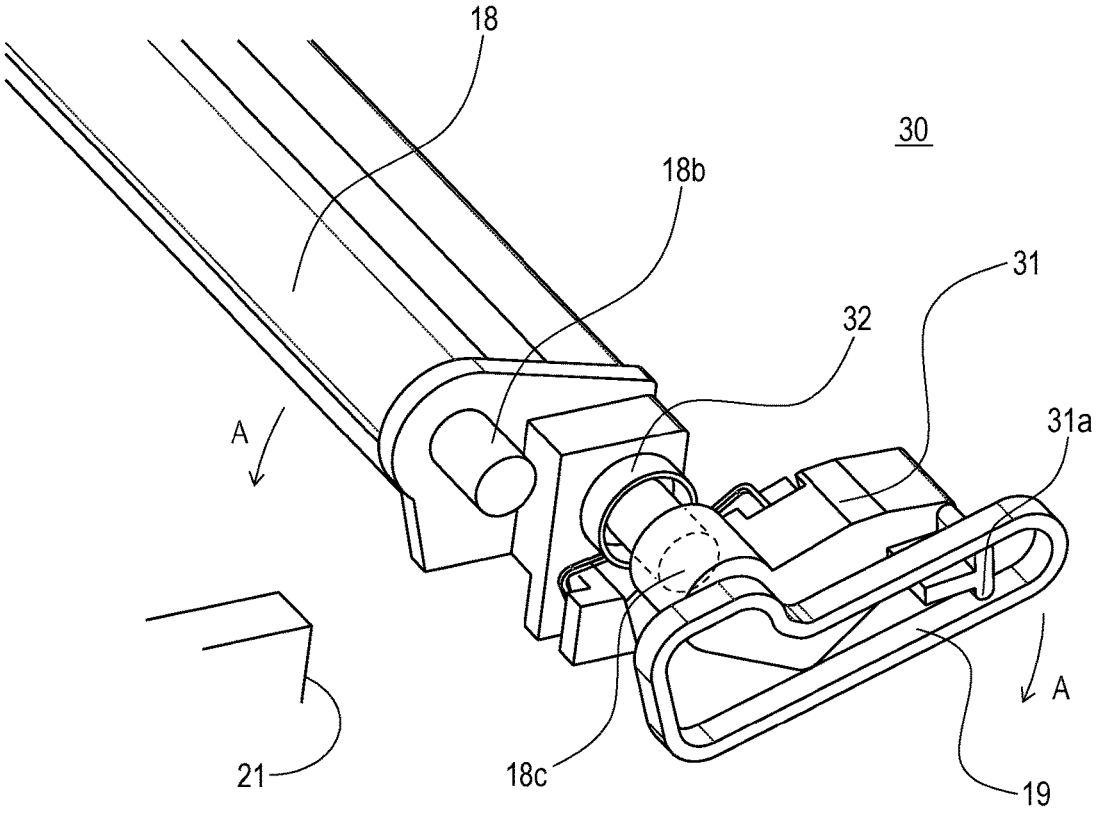
FIG. 10 is a perspective view of a shutter link.

Using FIGS. 10 to 13, the positioning configuration of the open position of the entrance shutter 18 in this example is specifically described. The apparatus main body 1 includes a link mechanism 30 described later. FIG. 10 is a perspective view in the vicinity of the link mechanism 30 at the time when the entrance shutter 18 is located at the closed position (the first position). The entrance shutter 18 is supported by the apparatus main body 1 so as to be able to rotate about an axis 18*b*. A link member 31 is rotatably supported by an axis 18*c* provided in the entrance shutter 18, and includes a contact portion 31*a* at an end different from the supporting portion. The contact portion 31*a* is guided by a shutter guide portion 19 of the apparatus main body 1. An urge spring 32 is provided between the entrance shutter 18 and the link member 31, and urges the entrance shutter 18 and the link member 31 such that the entrance shutter 18 and the link member 31 are mutually opened in the respective directions of arrows A.

Figure 11:
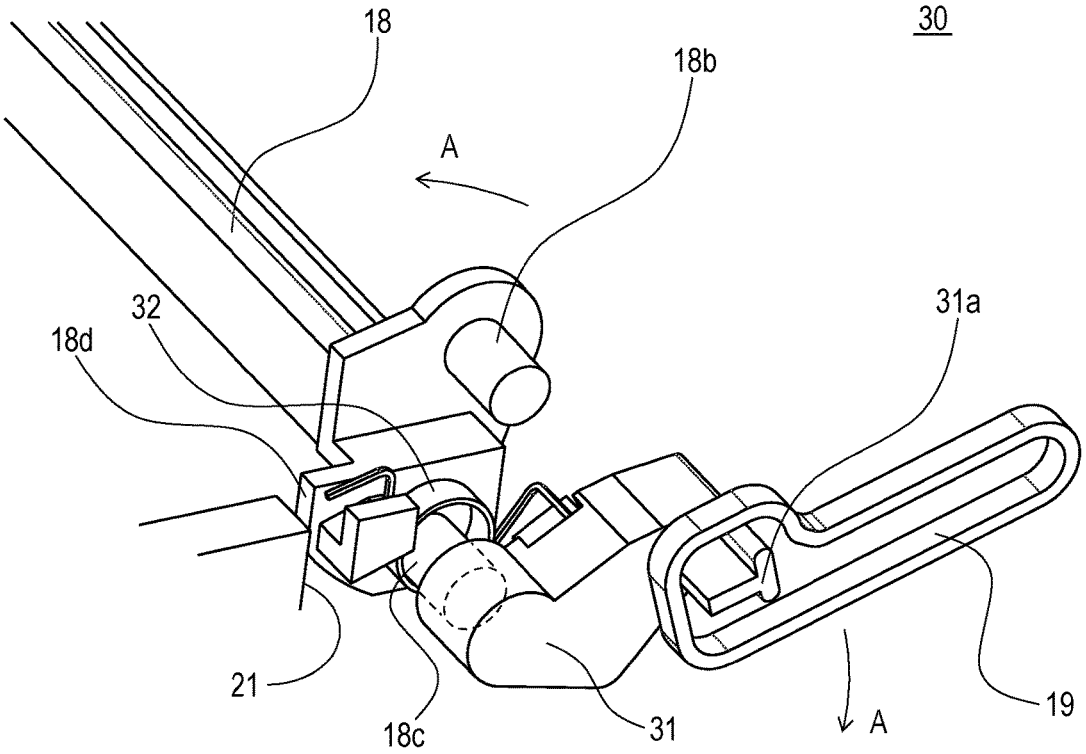
FIG. 11 is a perspective view of the shutter link.

FIG. 11 is a perspective view in the vicinity of the link mechanism 30 at the time when the entrance shutter 18 is located at the open position (the 2nd position). The entrance shutter 18 is pushed by the cartridge C, and is rotated from the closed position to the open position. When the entrance shutter 18 is at the open position, a shutter lock face 18*d* contacts a shutter rotation stopper (regulating portion) 21 provided in the apparatus main body 1. Thus, the entrance shutter 18 is not rotated any more. The link member 31 is guided along the shutter guide portion 19, while the entrance shutter 18 is opened and closed. When the entrance shutter 18 is rotated to the position where the entrance shutter 18 contacts the shutter rotation stopper 21, even if the entrance shutter 18 is pushed by the cartridge C, the entrance shutter 18 is not rotated further, and only the link member 31 is rotated about the axis 18*c*. Accordingly, the posture at the time when the entrance shutter 18 is at the open position (the posture at the time of functioning as the sheet conveyance guide) is always the posture at the time of contacting the shutter rotation stopper 21. In other words, since the individual difference of the posture at the time when the entrance shutter 18 functions as the sheet conveyance guide becomes small, the guidance accuracy of the sheet by the entrance shutter 18 is improved.

Comparing FIG. 10 with FIG. 11, it can be seen that the urge spring 32 is compressed as the entrance shutter 18 is rotated from the closed state to the opened state. Therefore, the urge spring 32 functions to urge the entrance shutter 18 to a state where the entrance shutter 18 is closed from a state where the entrance shutter 18 is opened. Additionally, the support shape of a rotational fulcrum and the rotation stopper shape for the entrance shutter 18 that the apparatus main body 1 provides can be given to the same component. Thus, it is unnecessary to provide excessive components in order to determine the position of the entrance shutter 18, and the entrance shutter 18 is accurately positioned.

Figure 12:
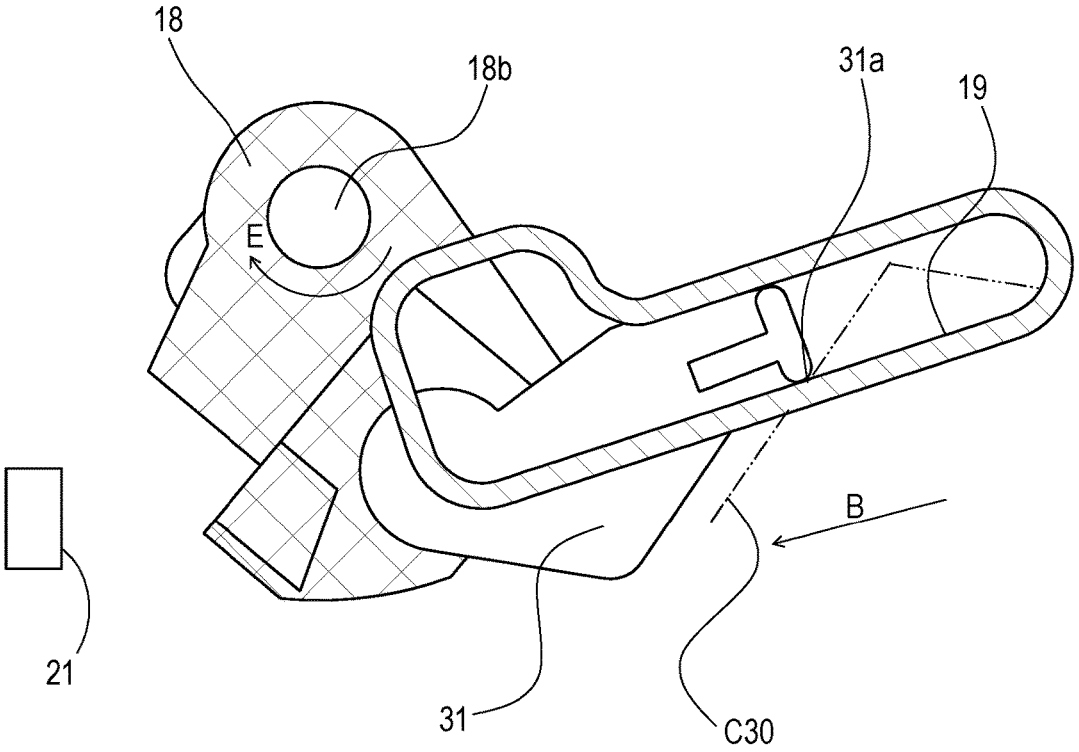
FIG. 12 is a cross-sectional view of the shutter link.
Figure 13:
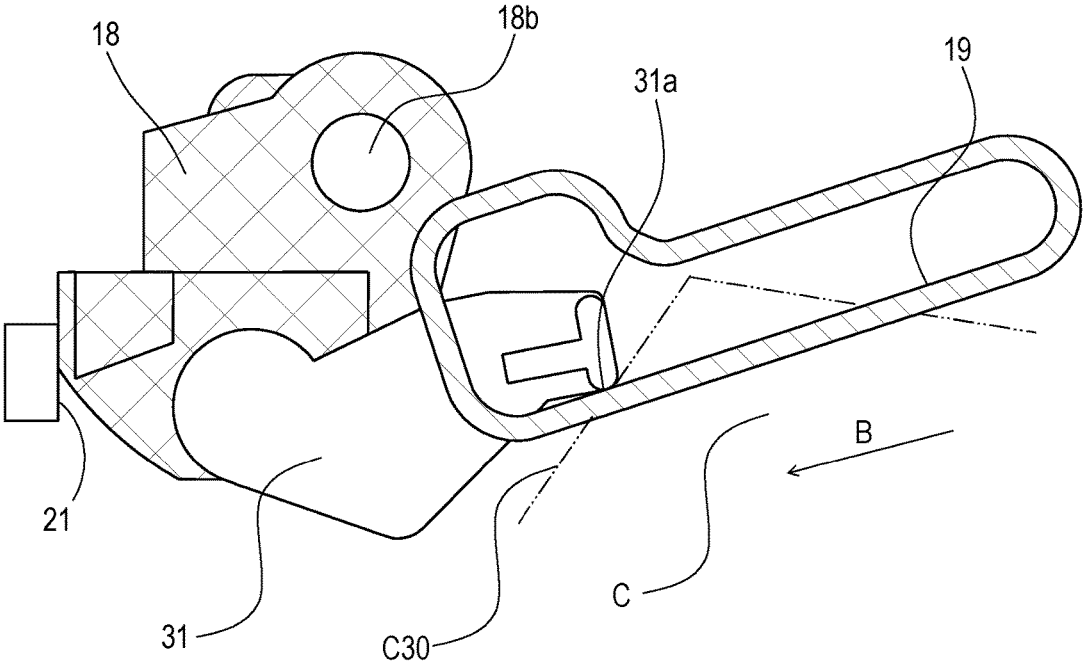
FIG. 13 is a cross-sectional view of the shutter link.

FIG. 12 is a cross-sectional view in the vicinity of the link mechanism 30 at the time when the entrance shutter 18 is in between the closed position and the open position, and FIG. 13 is a cross-sectional view in the vicinity of the link mechanism 30 at the time when the entrance shutter 18 is at the position (open position) where the entrance shutter 18 contacts the shutter rotation stopper 21. The cartridge C illustrated with a two-dot chain line moves in the direction of an arrow B with the insertion into the apparatus main body 1. A link contact portion C30 of the cartridge C contacts the contact portion 31*a*, and the entrance shutter 18 is opened in conjunction with the insertion of the cartridge C. At the time of detachment of the cartridge C, the entrance shutter is closed by the reverse operation. While the entrance shutter 18 moves to the open position from the closed position (a path 1), the entrance shutter 18 is opened in the direction of an arrow E about the axis 18*b* by the force with which the user pushes the cartridge C.

Figure 14:
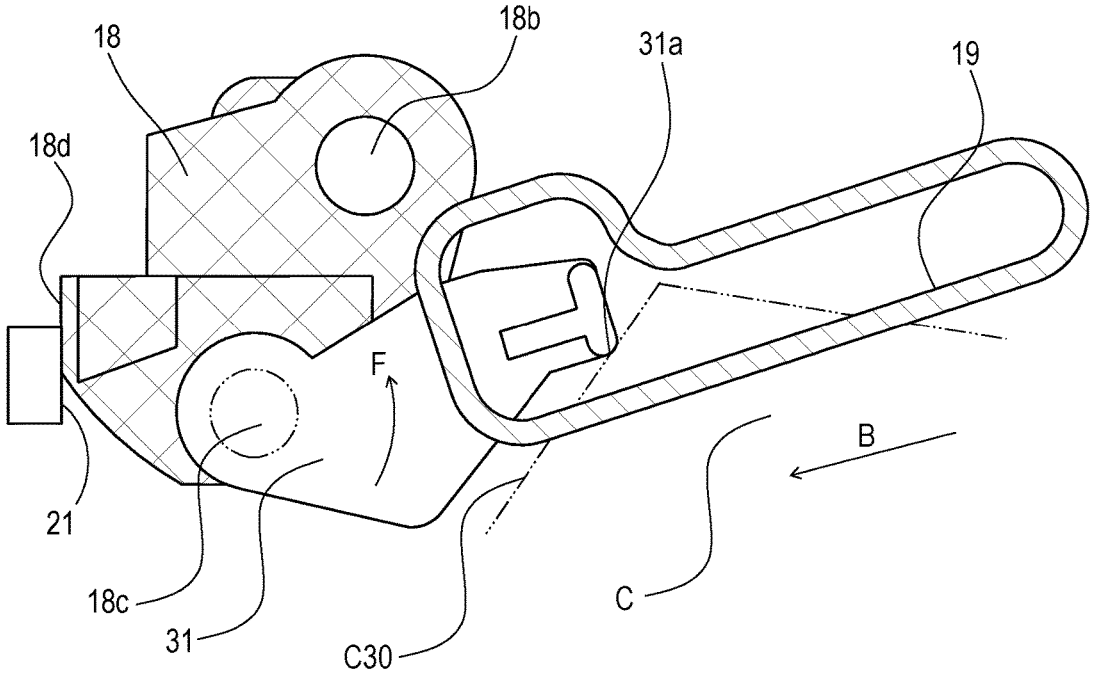
FIG. 14 is a cross-sectional view of the shutter link.

FIG. 14 is a cross-sectional view in the vicinity of the link mechanism 30 at the time when the link member 31 is further pushed by the link contact portion C30 in the state where the entrance shutter 18 is at the open position. On this occasion, the shutter lock face 18*d* is urged to the shutter rotation stopper 21 by the urge spring 32, and the rotation is regulated. The cartridge C gives a reaction force to the link member 31 in the normal line direction of a surface of the link contact portion C30. This reaction force is not parallel to the direction B, and has a component in the direction crossing the direction B. Thus, the link member 31 can be rotated in the direction of an arrow F (a path 2) about the axis 18*c*. As can be understood by comparing FIG. 13 with FIG. 14, when the link member 31 is rotated in the direction F, the contact portion 31*a* moves to slide on an inclined surface of the link contact portion C30. In this way, even if the cartridge C excessively pushes the link member 31, the closed position of the entrance shutter 18 can maintain the position where the entrance shutter 18 contacts the shutter rotation stopper 21.

Therefore, the contact portion 31*a* is designed to be pushed in by the amount that takes into account the expected relative position gap between the link contact portion C30 and the contact portion 31*a* in the state where the cartridge C is attached to a right location inside the apparatus main body 1. In this way, the accurate open position of the entrance shutter 18 can be realized, without being affected by the accuracy of a component shape related to a shutter mechanism.

Figure 15:
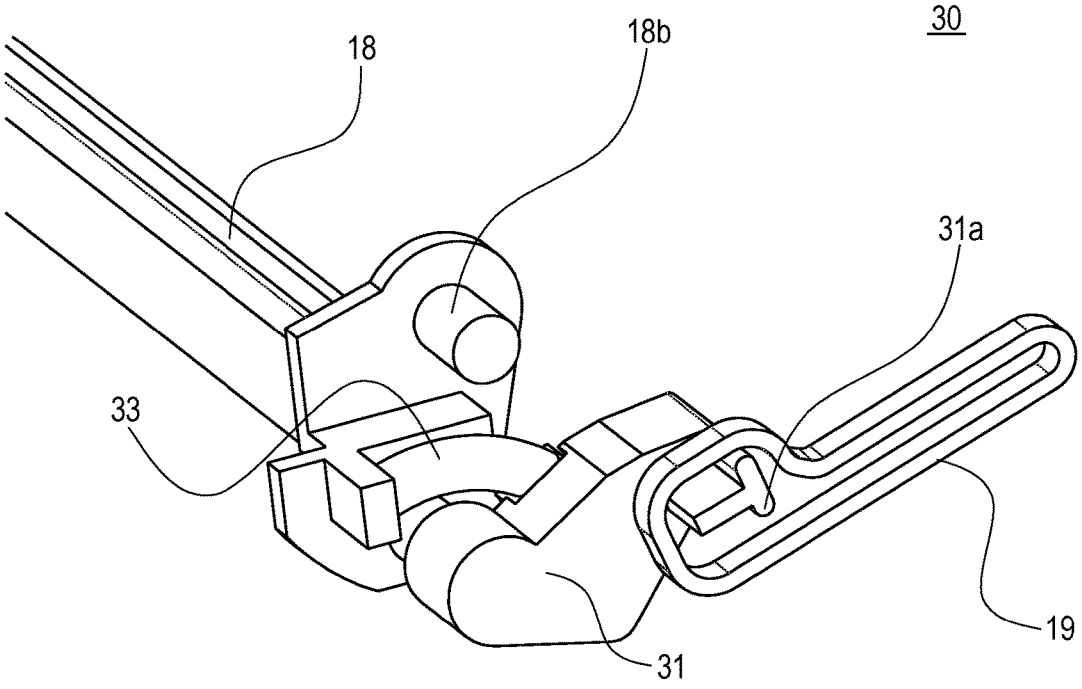
FIG. 15 is a perspective view of other example of the shutter link.

Further, in this example, the description is given by using a torsion coil spring as the urge spring 32. However, as illustrated in FIG. 15, a compression spring 33 may be used, or a tension spring may be used.

As described above, the image forming apparatus of this example includes the link mechanism 30 which the attachable and detachable unit C contacts, and the regulating portion 21 regulating the movement of the shutter 18. Then, when the attachable and detachable unit C is further pushed in the attaching direction at the time when the shutter 18 is located in the second position, the link mechanism 30 allows to move the attachable and detachable unit C in the attaching direction of the attachable and detachable unit C to keep a position of the shutter 18 at the second position by the regulating portion 21. Therefore, it is possible to provide the image forming apparatus that provides stable sheet conveyance even if the image forming apparatus includes the entrance shutter 18 serving as the sheet conveyance guide.

Example 2

Figure 16:
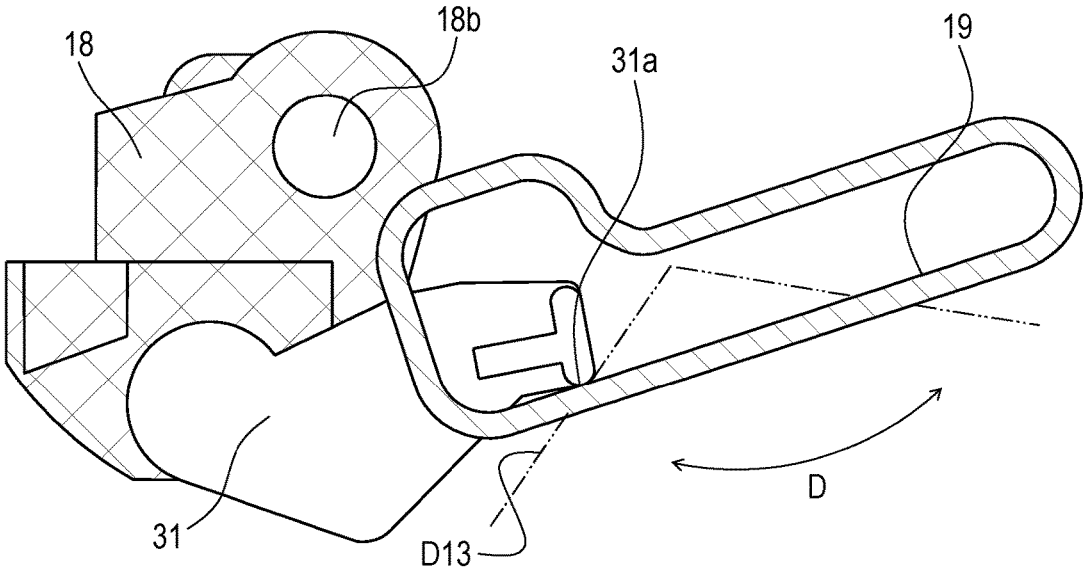
FIG. 16 is a cross-sectional view of the shutter link of Example 2.

Next, Example 2 is described by using FIG. 16. Note that a description of configurations having the same configurations as in Example 1 is omitted.

In an apparatus of this example, if a door is closed when the shutter is at the first position closing the sheet inlet, the shutter is moved from the first position to the second position opening the sheet inlet according to a closing operation. Then, a door 13 of the apparatus of this example is provided with a link contact portion D13 having the same function as that of the contact portion C30 in Example 1. That is, with the opening and closing operation of the door 13, the link contact portion D13 moves in the direction of an arrow D, and contacts the contact portion 31*a*. Thus, the entrance shutter 18 performs the same operation as in Example 1.

As described above, the apparatus main body of this example includes the link mechanism that the door 13 contacts, and the regulating portion 21 regulating the movement of the shutter 18. Then, when the door 13 is further pushed in a closing direction at the time when the shutter 18 is located at the second position, the link mechanism allows to move the door 13 in the closing direction of the door 13 to keep a position of the shutter at the second position by the regulating portion 21.

Example 3

Figure 17:
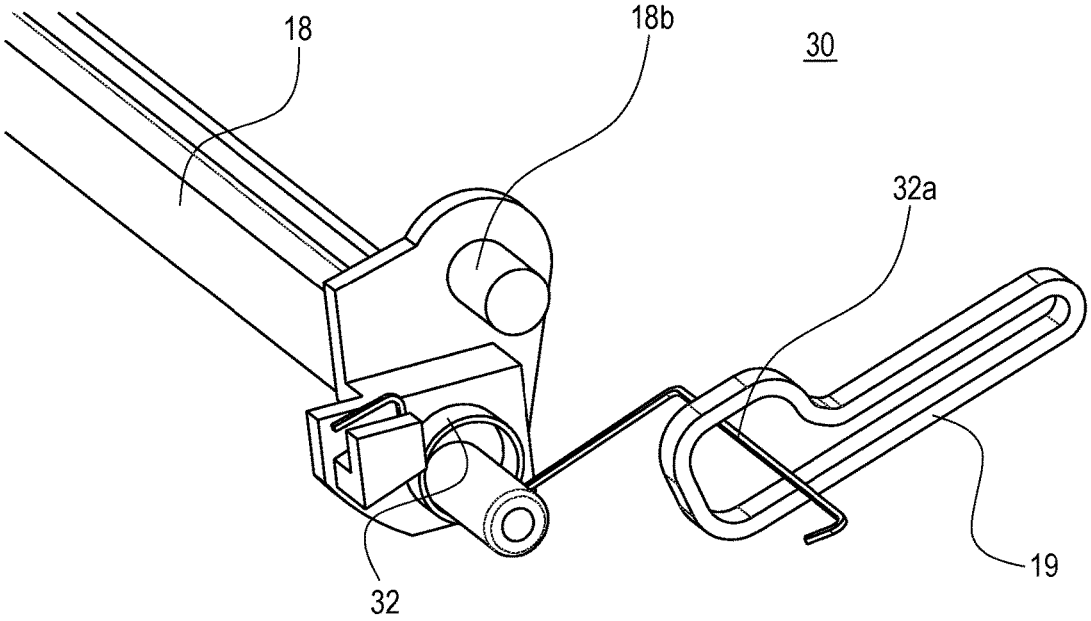
FIG. 17 is a perspective view of the shutter link of Example 3.
Figure 18:
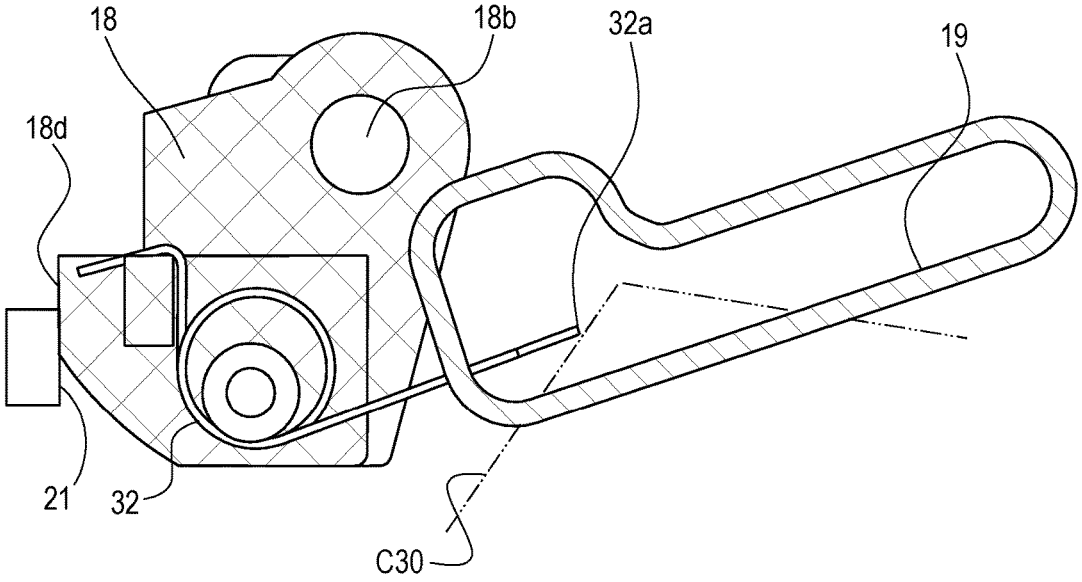
FIG. 18 is a cross-sectional view of the shutter link of Example 3.

Next, Example 3 is described by using FIGS. 17 and 18. Note that a description of configurations having the same configurations as in Example 1 is omitted.

In an apparatus of this example, the urge spring 32 is a torsion coil spring. The arm shape on the side urging the link member 31 is a shape for performing the same operation as the link member 31 illustrated in Example 1. The further reduction of components can be achieved by using a part of the urge spring 32 as the contact portion 32*a* as illustrated in FIGS. 17 and 18.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-225570, filed Nov. 24, 2017, which is hereby incorporated by reference herein in its entirety.

What is claimed is:

1. An image forming apparatus forming a toner image on a sheet, the image forming apparatus comprising:

an apparatus main body;

a guide configured to guide an attachable and detachable unit attachable to and detachable from the apparatus main body; and a fixing unit configured to fix the toner image formed on a sheet to the sheet, the fixing unit including a shutter configured to open or close a sheet inlet of the fixing unit, wherein in a case where the attachable and detachable unit is attached to the apparatus main body when the shutter is located at a first position at which the sheet inlet is closed, the shutter moves from the first position to a second position at which the sheet inlet is opened, according to an attaching operation, wherein the apparatus main body includes a link mechanism that the attachable and detachable unit contacts, and a regulating portion configured to regulate movement of the shutter, and in a case where the attachable and detachable unit is further pushed in an attaching direction when the shutter is located at the second position, the link mechanism allows to move the attachable and detachable unit in the attaching direction while keeping a position of the shutter at the second position by the regulating portion.

2. An image forming apparatus according to claim 1, wherein the shutter is provided at a position opposed to a surface of the sheet on an opposite side of a surface of a sheet bearing an unfixed toner image.

3. An image forming apparatus according to claim 1, wherein the link mechanism is rotatably provided with respect to the shutter.

4. An image forming apparatus according to claim 3, wherein the link mechanism is provided in an end of the shutter in a rotation axial direction of the shutter.

5. An image forming apparatus according to claim 3, wherein in a case where the attachable and detachable unit is further pushed in the attaching direction when the shutter is located at the second position, a force with which the attachable and detachable unit pushes the shutter is changed into a force rotating the link mechanism with respect to the shutter.

6. An image forming apparatus according to claim 1, further comprising an urge spring configured to urge the shutter from the second position to the first position.

7. An image forming apparatus according to claim 6, wherein a part of the urge spring is the link mechanism that the attachable and detachable unit contacts.

8. An image forming apparatus according to claim 1, further comprising the attachable and detachable unit, wherein the attachable and detachable unit includes a photosensitive member to which light corresponding to an image is irradiated.

9. An image forming apparatus forming a toner image on a sheet, the image forming apparatus comprising:

an apparatus main body;

an opening and closing member configured to open or close with respect to the apparatus main body; and a fixing unit configured to fix the toner image formed on a sheet onto the sheet, the fixing unit including a shutter configured to open or close a sheet inlet of the fixing unit, wherein in a case where the opening and closing member is closed when the shutter is located at a first position closing the sheet inlet, the shutter moves from the first position to a second position opening the sheet inlet according to a closing operation, wherein the apparatus main body includes a link mechanism that the opening and closing member contacts, and a regulating portion regulating movement of the shutter, and wherein in a case where the opening and closing member is further pushed in a closing direction when the shutter is located at the second position, the link mechanism allows to move the opening and closing member in the closing direction while keeping a position of the shutter at the second position by the regulating portion.

10. An image forming apparatus according to claim 9, wherein the shutter is provided at a position opposed to a surface of the sheet on an opposite side of a surface of a sheet bearing an unfixed toner image.

11. An image forming apparatus according to claim 9, wherein the link mechanism is rotatably provided with respect to the shutter.

12. An image forming apparatus according to claim 11, wherein the link mechanism is provided in an end of the shutter in a rotation axial direction of the shutter.

13. An image forming apparatus according to claim 11, wherein in a case where the opening and closing member is further pushed in the closing direction when the shutter is located at the second position, a force with which the opening and closing member pushes the shutter is changed into a force rotating the link mechanism with respect to the shutter.

14. An image forming apparatus according to claim 9, further comprising an urge spring configured to urge the shutter from the second position to the first position.

* * * * *